US008967328B2

(12) United States Patent
Kaneda et al.

(10) Patent No.: US 8,967,328 B2
(45) Date of Patent: Mar. 3, 2015

(54) SOUND INSULATION MATERIAL AND METHOD FOR PREPARING THE SAME

(71) Applicant: Nishikawa Rubber Co., Ltd., Hiroshima (JP)

(72) Inventors: Hiroaki Kaneda, Hiroshima (JP); Shinichiro Emori, Hiroshima (JP); Taisuke Kameoka, Hiroshima (JP)

(73) Assignee: Nishikawa Rubber Co., Ltd., Hiroshima (JP)

( * ) Notice: Subject to any disclaimer, the term of this patent is extended or adjusted under 35 U.S.C. 154(b) by 0 days.

(21) Appl. No.: 13/690,228

(22) Filed: Nov. 30, 2012

(65) Prior Publication Data

US 2013/0140108 A1 Jun. 6, 2013

(30) Foreign Application Priority Data

Dec. 2, 2011 (JP) ..... 2011-264912

(51) Int. Cl.
*E04B 1/84* (2006.01)
*G10K 11/168* (2006.01)

(52) U.S. Cl.
CPC ..... *E04B 1/84* (2013.01); *G10K 11/168* (2013.01)
USPC ..... 181/286; 181/291

(58) Field of Classification Search
CPC ..... G10K 11/168; E04B 1/84
USPC ..... 181/286, 291, 294, 295
See application file for complete search history.

(56) References Cited

U.S. PATENT DOCUMENTS

| | | | | | |
|---|---|---|---|---|---|
| 2,464,380 | A * | 3/1949 | Daiber | 2/458 |
| 2,714,416 | A * | 8/1955 | Fener | 156/583.2 |
| 2,730,721 | A * | 1/1956 | Van Veen | 5/413 R |
| 3,987,134 | A * | 10/1976 | Shiina et al. | 264/45.4 |
| 5,335,483 | A * | 8/1994 | Gavronsky et al. | 53/451 |
| 5,744,763 | A * | 4/1998 | Iwasa et al. | 181/286 |
| 6,966,401 | B2 * | 11/2005 | Kojima | 181/233 |
| 7,658,543 | B2 * | 2/2010 | Shiokawa et al. | 383/107 |

FOREIGN PATENT DOCUMENTS

| | | |
|---|---|---|
| JP | 57-183953 | 11/1982 |
| JP | 8-185188 | 7/1996 |
| JP | 2003-150169 | 5/2003 |

OTHER PUBLICATIONS

English translation for JP 2003150169, accessed Oct. 22, 2013 from JPO website.*

* cited by examiner

*Primary Examiner* — Jeremy Luks
(74) *Attorney, Agent, or Firm* — Alston & Bird LLP

(57) ABSTRACT

Two sheets of nonwoven fabric with the same shape and size each including a rectangular body 11*a* and a funnel-shaped projection 11*b* projecting from one side of the body 11*a* are stacked, and bonded together by heat welding at each side of the body 11*a* except the projection 11*b* and both sides of the projection 11*b*. Joint portions 13*a*, 13*b*, 13*c*, and 13*d* projecting inward from a joint 13 are located on three sides and four corners of the body 11*a* except the side provided with the projection 11*b*, and project to depths at which the joints do not interfere insertion of a nozzle 16 into a center portion of the bag. The nozzle 16 is inserted through an opening 15 of the projection 11*b*, and the bag is filled with a granular elastic material 12. Then, the projection 11*b* is removed, and the opening is closed.

11 Claims, 6 Drawing Sheets

SOUND INSULATION MATERIAL AND METHOD FOR PREPARING THE SAME

CROSS-REFERENCE TO RELATED APPLICATION

This application claims priority to Japanese Patent Application No. 2011-264912 filed on Dec. 2, 2011, the disclosure of which including the specification, the drawings, and the claims is hereby incorporated by reference in its entirety.

BACKGROUND

The present disclosure relates to sound insulation materials which are to be used in places requiring sound insulation, e.g., buildings, vehicles, and aircraft, and enclose granular elastic materials of rubber or thermoplastic elastomers, and methods for preparing such sound insulation materials.

As a sound insulation material of this type, Japanese Patent Publication No. H08-185188 proposes, for example, a sound insulation material in which a granular elastic material of, for example, pulverized rubber, previously formed granular rubber, or a rubber-like elastic resin is covered with a cover layer of a sheet made of nonwoven fabric or a resin, a sound insulation material in which a latticed partition plate or a plurality of partition boxes filled with a granular elastic material is interposed between cover layers, and a sound insulation material in which the cover layer is provided integrally with a projection for separation. Japanese Patent Publication No. 2003-150169 proposes, for example, a sound insulation material prepared by filling a bag constituted by, for example, woven fabric, nonwoven fabric, or a resin film with pulverized foam particles and sealing the bag and a sound insulation material prepared by connecting, with pins or by sewing, both sides of a bag enclosing foam particles. Japanese Patent Publication No. S57-183953 proposes a packaging bag housing powder in which a center portion of the bag is sealed with heat in order to prevent collapse when bags with a uniform thickness are stacked.

A sound insulation material prepared by filling a bag with a granular elastic material has a high sound deadening property. However, in application of such a sound insulation material in a place where vibration occurs, e.g., vehicles or aircraft, vibration causes uneven distribution of a granular elastic material 2 filling a bag 1 as illustrated in FIG. 1, resulting in degradation of the sound deadening property and occurrence of a bulge of a portion in which the material 2 is locally present. To stabilize the sound deadening property and uniformize the thickness, it is necessary to prevent uneven distribution of the granular elastic material.

The above-described structures in which the inside of the bag is partitioned by the latticed partition plate or partition boxes, bags are connected together with pins or by sewing, or the center portion of the bag is sealed with heat, can inhibit movement of the granular elastic material to prevent uneven distribution of the granular elastic material and, thereby, uniformize the thickness. However, preparation of a sound insulation material by the process of filling a latticed partition plate or partition boxes with a granular elastic material, providing a cover, and then welding the rim of the cover with heat or the process of partially welding the rim of a cover with heat to form a bag, filing the bag with a granular elastic material through an unwelded portion, and then inserting pins into, or sewing, the bag, causes an increase in the number of parts, leading to a complicated structure and also an increase in the number of processes. As a result, the cost increases. In addition, in the case of connecting bags with pins, water might enter from portions at which the pins are inserted. In this aspect, in the packaging bag whose center portion is sealed with heat, heat sealing on the center portion is performed simultaneously with heat sealing on the rim of the bag. Thus, the structure and processes are simplified, thereby reducing the cost. However, in filling a bag with a granular elastic material, a center portion of the bag sealed with heat tends to be an obstacle to the filling.

SUMMARY

It is therefore an object of the present disclosure to provide a sound insulation material which can reduce uneven distribution of an enclosed granular elastic material and has a small variation in thickness, a simple structure, can be prepared by simple processes, and can be easily filled with the granular elastic material, and a method for preparing such a sound insulation material.

A sound insulation material in an aspect of the present disclosure includes a bag which is closed at a rim thereof and is made of nonwoven fabric or a resin sheet; and a granular elastic material enclosed in the bag, and a joint portion projecting inward from the rim of the bag is located on at least a portion of the rim of the bag.

In this sound insulation material, even with vibration, the joint portion projecting inward from the rim can inhibit movement of the granular elastic material. Accordingly, uneven distribution of the granular elastic material can be prevented or reduced. Consequently, a variation in the sound deadening property can be reduced. In addition, the joint portion can reduce a variation in the thickness of the sound insulation material. Thus, problems such as a trouble in parts around the sound insulation material caused by bulging and limited design in layout are less likely to occur. Further, in forming the joint portion, the unnecessity of parts and processes dedicated to prevention of uneven distribution can reduce the cost. Moreover, since the joint portion projects from the rim and no joints are provided at the center of the bag in injecting the granular elastic material into a center portion of the bag, advantages in which the joint is less likely to interfere the injection, for example, can be achieved.

In a preferred aspect of the present disclosure, the joint portion has a tapered shape whose width gradually decreases toward a center of the bag. With this structure, in injecting the granular elastic material, even when the granular elastic material comes into contact with the joint, the granular elastic material can be relatively smoothly injected. As a result, the granular elastic material can reach every corner of the bag.

In a preferred aspect of the present disclosure, the granular elastic material enclosed in the bag is at least partially made of foam rubber or a foam resin. Thus, the sound insulation property can be further enhanced.

In a preferred aspect of the present disclosure, the joint portion projects inward to a distance at which the joint does not interfere injection of the granular elastic material when a nozzle for injecting the granular elastic material is inserted into a center portion of the bag to fill the bag with the granular elastic material. With this structure, in injecting the granular elastic material with the nozzle, the insertion of the nozzle into the center portion of the bag can be smoothly performed.

A method for preparing the sound insulation material described above in an aspect of the present disclosure includes either folding nonwoven fabric or a resin sheet into two sheets or stacking two sheets of nonwoven fabric or a resin, and bonding rims of the two sheets together except for portions of the rims, thereby forming a bag; filling the bag with a granular elastic material through portions of the rims which are not bonded; and bonding the portions of the rims which are not bonded after filling the bag with the granular elastic material. In the bonding of the rims, a portion to be bonded on the rim and at least a projecting portion to be bonded projecting inward from the rim in one of the sheets are bonded at the same time to a portion to be bonded on the rim and a projecting portion to be bonded projecting inward from the rim in the other sheet.

DETAILED DESCRIPTION

A sound insulation material according to an embodiment of the present disclosure will be described hereinafter with reference to the drawings.

Figure 1:
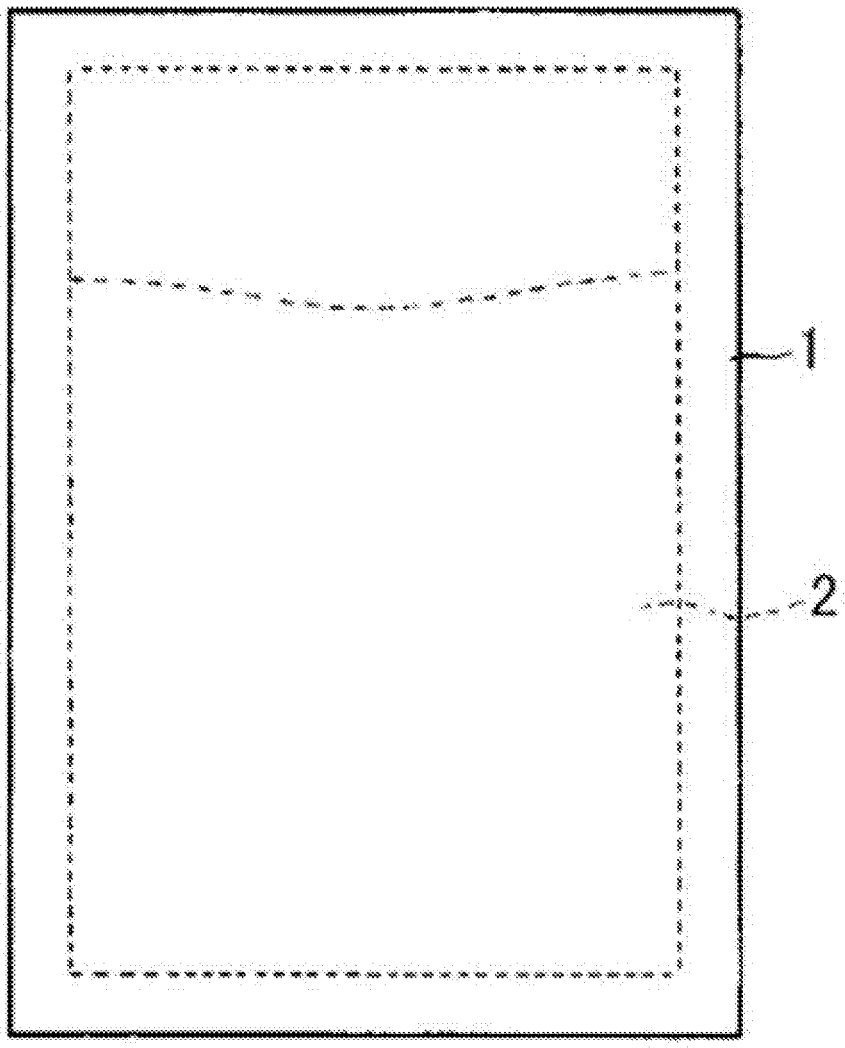
FIG.1 PRIOR ART
FIG. 1 is a view illustrating uneven distribution of a granular elastic material in a conventional sound insulation material.
Figure 2:
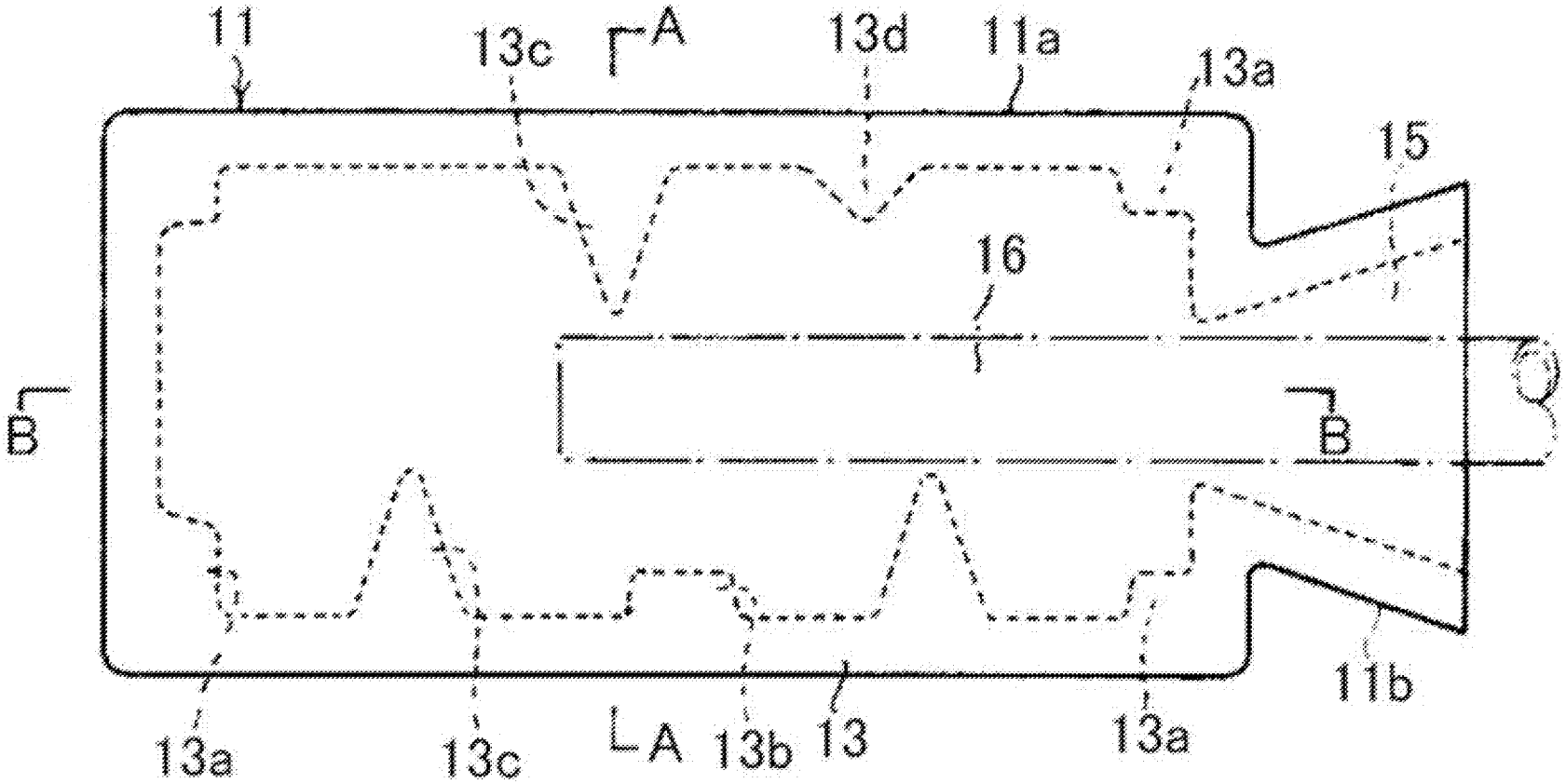
FIG. 2 is a plan view illustrating a bag for use in a sound insulation material according to an embodiment of the present disclosure.
Figure 3:
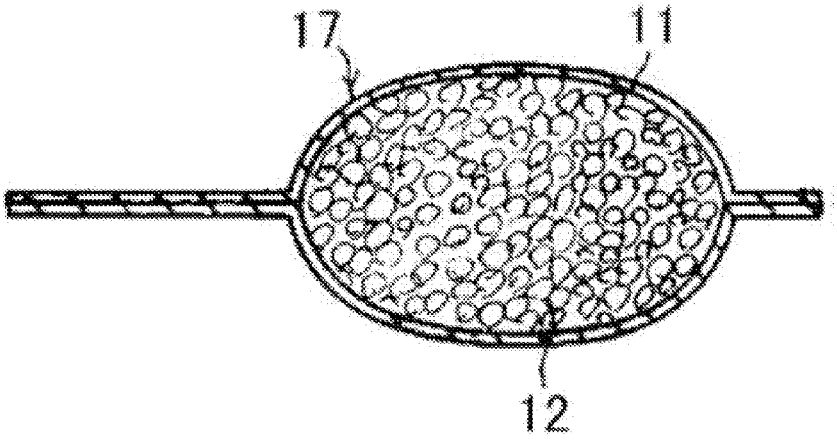
FIG. 3 is a cross-sectional view illustrating the sound insulation material taken along the line A-A in FIG. 2.
Figure 4:
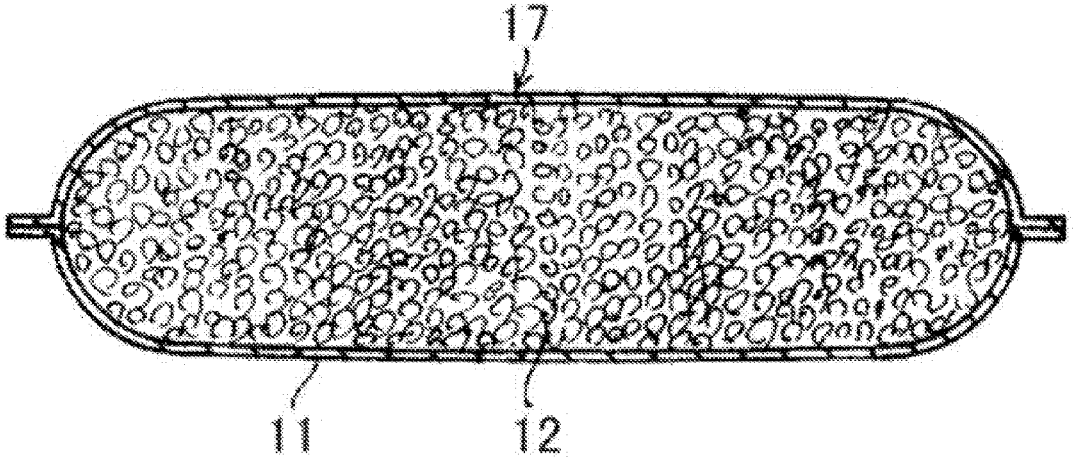
FIG. 4 is a cross-sectional view illustrating the sound insulation material taken along the line B-B in FIG. 2.

FIG. 2 illustrates a bag 11 for use in the sound insulation material. FIG. 3 is a cross-sectional view illustrating the bag 11 filled with a granular elastic material 12 and taken along the line A-A in FIG. 2. FIG. 4 is a cross-sectional view illustrating the bag 11 filled with the granular elastic material 12 and taken along the line B-B in FIG. 2. The bag 11 is prepared in the following manner. First, two sheets of nonwoven fabric or a resin with the same shape and the same size each including a rectangular body 11*a* and a funnel-shaped projection 11*b* projecting from the center of one side of the body 11*a* are stacked. Then, these sheets are bonded together into the shape of an ice pack by heat welding (heat sealing) at each side of the body 11*a* except the projection 11*b* and both sides of the projection 11*b* or by other means such as adhesion, sewing, or a combination of these means. Joint portions 13*a*, 13*b*, 13*c*, and 13*d* projecting inward from a joint 13 are located on three sides and four corners of the body 11*a* except the side on which the projection 11*b* is located.

The joints 13*a*, 13*b*, 13*c*, and 13*d* are constituted by triangles 13*c* and 13*d* and square shapes 13*a* and 13*b* which are different from one another in degrees of projection, size, and shape. The shapes of the joint portions are not limited to those illustrated in FIG. 2, and may be pentagons, other polygons, approximately semicircles, or approximately semiellipses, or may form parabolas in contour, for example. Among these shapes, a tapered shape whose width gradually decreases toward the center of the bag, e.g., the triangles 13*c* and 13*d* illustrated in FIG. 2, is preferable. This is because a granular elastic material can easily reach the corners of the bag 11 when the bag 11 is filled with the granular elastic material, which will be described later. The corner of each joint portion is preferably rounded or chamfered by providing a slope. In this manner, in filling the bag with the granular elastic material, the granular elastic material is smoothly injected without being interrupted by the corners of the joints.

The joint portions 13*a*, 13*b*, 13*c*, and 13*d* provided on opposed sides of the bag 11 are also designed so as not to interrupt insertion of a nozzle, which will be described later, even with the maximum amount of projection toward the center of the bag. This projection amount is, for example, preferably 3 mm or more, more preferably 5 mm or more, much more preferably 10 mm or more, and preferably less than or equal to a half of the width of the bag 11.

Figure 5:
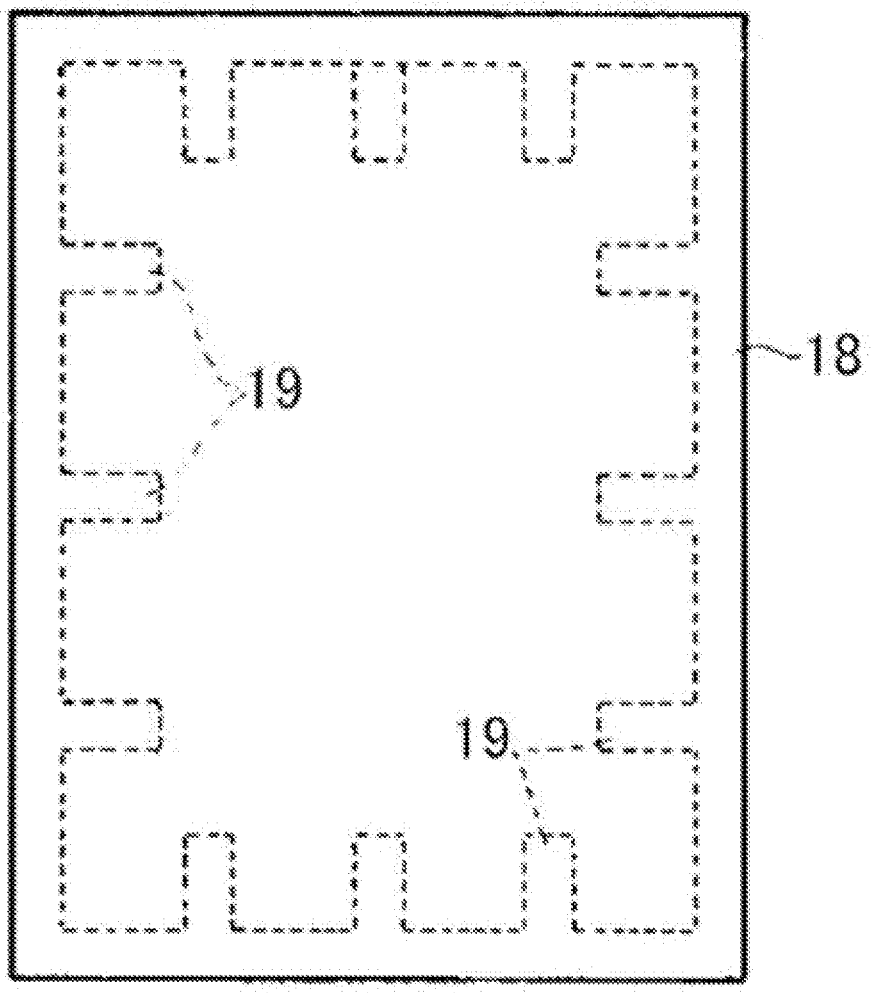
FIG. 5 is a plan view illustrating a sound insulation material according to another embodiment of the present disclosure.

The joint portions 13*a*, 13*b*, 13*c*, and 13*d* of the bag 11 have various shapes and sizes. Alternatively, all the joint portion may have the same shape and the same size. FIG. 5 illustrates a sound insulation material 18 as an example in which all the joint portions 19 have the same pin shape with the same size.

Figure 6:
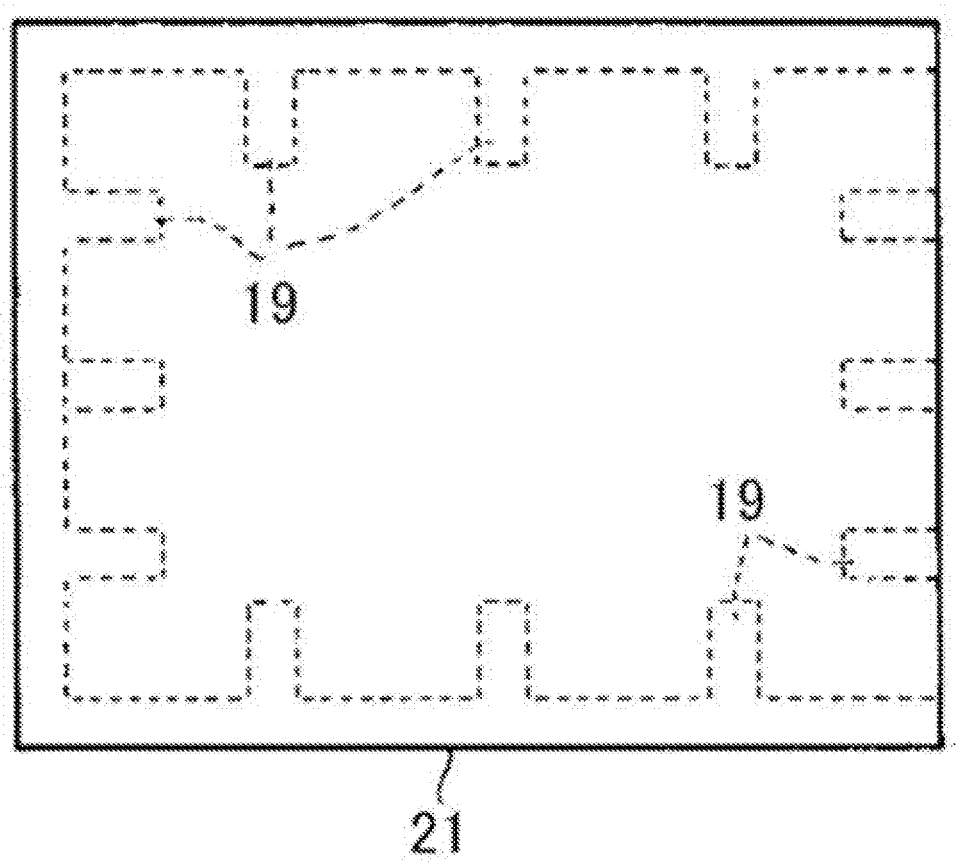
FIG. 6 is a plan view illustrating a sound insulation material according to still another embodiment of the present disclosure.

The above-described sound insulation material of this embodiment is the bag 11 formed by stacking two sheets of nonwoven fabric or a resin and bonding the entire rims together. Alternatively, a single sheet of nonwoven fabric or a resin may be used such that the sheet is folded into two sheets and the other three sides of one of the sheets are bonded to the three associated sides of the other. FIG. 6 illustrates a sound insulation material 21 in which the joint portions 19 of the embodiment illustrated in FIG. 5 are provided on four sides of a bag including the folded side, in the same manner as in the example illustrated in FIG. 5. No joint 13 is provided on the folded side in FIG. 6. Alternatively, a joint 13 may also be provided on the folded side.

The joint 13 and the joint portions 13*a*, 13*b*, 13*c*, and 13*d*, or 19 are formed by, for example, heat welding, adhesion, or sewing as described above, or a combination of these processes. Among these processes, heat welding (heat sealing) is preferable. This is because the heat welding can be easily carried out, and enables the joints 13, 13*a*, 13*b*, 13*c*, and 13*d*, or 19 at the same time with the same process, thereby reducing the number of processes, and also reducing the preparation cost.

In forming the bag 11, the joint 13 is not formed in part of a rim of the bag, i.e., at the center of the side provided with the projection 11*b* in the illustrated example, in order to inject the granular elastic material. An opening 15 communicating the inside of the bag is formed by bonding both sides of the projection 11*b*. In injecting the granular elastic material 12 through the opening 15, one or more nozzles 16 with adjusted dimensions as illustrated in the drawing are used. Each of the nozzles 16 is inserted through the opening 15 to a distance of a half or more of the length of the bag 11 along the insertion direction. The joint portions 13*a*, 13*b*, 13*c*, and 13*d* project inward from the rim, and the amounts of projection are determined so as not to interrupt the insertion of the nozzles. Thus, the nozzles 16 can be smoothly inserted. After the insertion of the nozzles 16, the granular elastic material 12 is blown out and injected. To allow the granular elastic material 12 to be blown out and injected, the bag 11 has air permeability. To provide the bag 11 with air permeability, the bag 11 is preferably made of nonwoven fabric.

The granular elastic material 12 to be injected is, for example, an elastic material obtained by pulverizing used rubber or a used resin product of a rubber-like elastic material used for a weatherstrip or other types of sealers of vehicles or cushioning materials, or an elastic material dedicated to use for sound insulation materials. The granular elastic material 12 may be in a foam state or a solid state. Among these materials, a material obtained by pulverizing used rubber or a used resin product is preferably employed, and the resin product of rubber or a rubber-like elastic material is more preferably in a foam state. Recycling a used rubber product or a used resin product can save resources, and reduce the cost. The use of foam rubber or a foam resin can enhance the sound absorption (sound deadening) property. The granular elastic material 12 is not specifically limited in size and shape. The size of the granular elastic material 12 is in the range from 0.1 mm to 10 mm in most cases.

Examples of the rubber or the rubber-like elastic material described above include rubber such as EPDM rubber and natural rubber, thermoplastic elastomers (olefin-based TPO and styrene-based TPS). In the case of foam rubber, rubber having a specific gravity of 0.03-1.0 is used.

The granular elastic material 12 does not need to be entirely made of the same material, and may be made of a mixture of materials having different properties (e.g., compositions and specific gravities).

After the granular elastic material 12 has been injected into the bag 11 through the nozzles 16, an opening in a side in which the projection 11*b* is provided is closed by bonding. Simultaneously with closing this opening by bonding, the joint portions 13*a*, 13*b*, 13*c*, and 13*d*, or 19 may be formed.

After bonding the sides, the projection 11*b* is removed. This removal of the projection 11*b* may be performed by cutting with a cutter. Preferably, the projection 11*b* is removed by melting simultaneously with bonding by heat welding. Then, the bonding and the melting can be performed at the same time in a single process. The removal of the projection 11*b* may be performed before bonding the side so that the bonding is performed after the removal.

Figure 7:
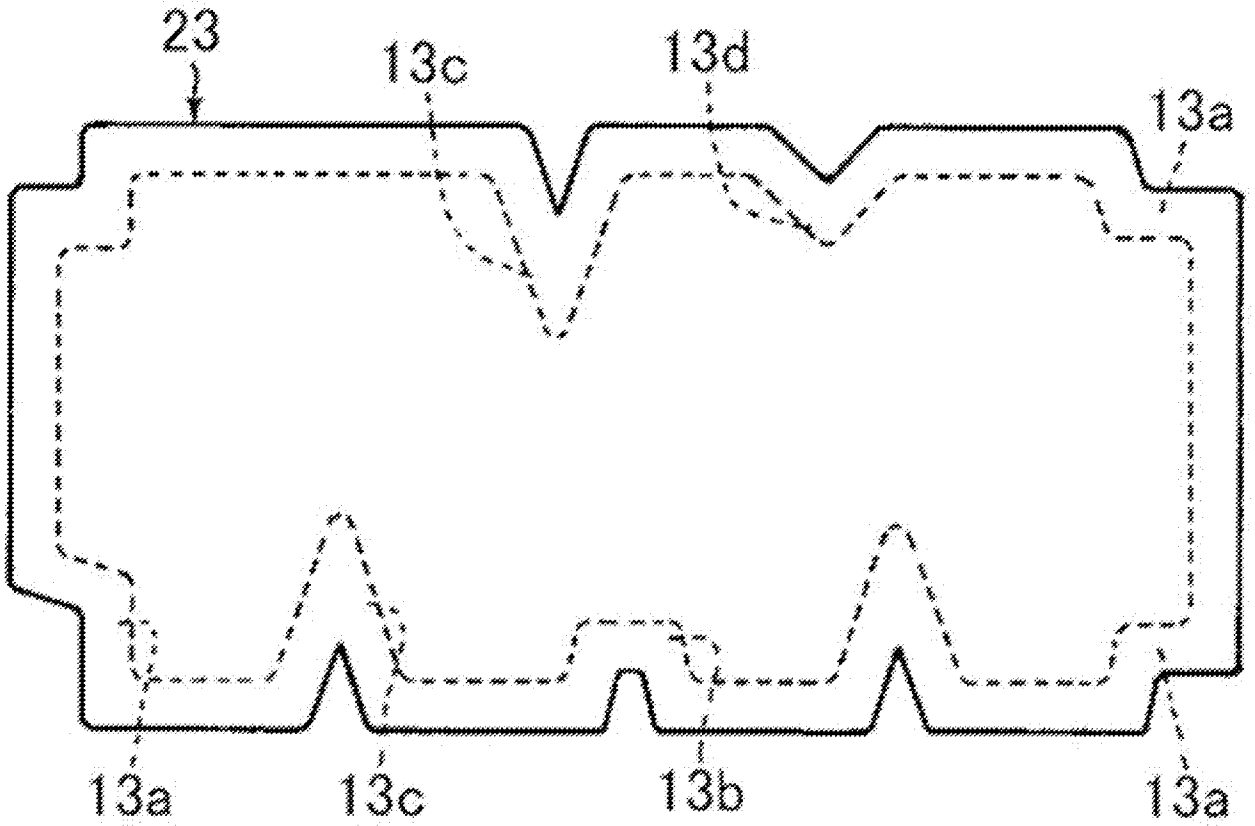
FIG. 7 is a plan view illustrating a sound insulation material according to yet another embodiment of the present disclosure.

The sound insulation materials 17, 18, and 21 of the foregoing embodiments have rectangular outer shapes, but may have outer shapes conforming to the shapes of the joint portions. The sound insulation material 23 illustrated in FIG. 7 is an example in which the contour of the outer shape conforms to the shapes of the joint portions 13*a*, 13*b*, 13*c*, and 13*d*.

In the manner described above, the sound insulation material 17 enclosing the granular elastic material is prepared. In this sound insulation material, the joint portions 13*a*, 13*b*, 13*c*, and 13*d* can reduce movement of the granular elastic material 12, resulting that uneven distribution of the granular elastic material 12 can be reduced and a substantially uniform thickness can be maintained.

What is claimed is:

1. A sound insulation material, comprising:

a bag which is closed at a rim thereof and is made of nonwoven fabric or a resin sheet, wherein the bag defines a single compartment; and a granular elastic material enclosed in the compartment defined by the bag, wherein the bag further defines an adhered portion projecting inward from the rim of the bag on at least a portion of the rim of the bag such that a shape of the compartment is partly defined by a shape of the adhered portion and the shape of the compartment is different from the shape of the bag, wherein the adhered portion is attached by heat welding, adhesive, or sewing, or a combination thereof.

2. The sound insulation material of claim 1, wherein the adhered portion has a tapered shape whose width gradually decreases toward a center of the bag.

3. The sound insulation material of claim 1, wherein the granular elastic material enclosed in the bag is at least partially made of foam rubber or a foam resin.

4. The sound insulation material of claim 1, wherein the adhered portion projects inward to a distance at which the adhered portion does not interfere with injection of the granular elastic material into the compartment when a nozzle for injecting the granular elastic material is inserted into a center portion of the bag to fill the bag with the granular elastic material.

5. The sound insulation material of claim 2, wherein the adhered portion projects inward to a distance at which the adhered portion does not interfere with injection of the granular elastic material into the compartment when a nozzle for injecting the granular elastic material is inserted into a center portion of the bag to fill the bag with the granular elastic material.

6. The sound insulation material of claim 3, wherein the adhered portion projects inward to a distance at which the joint does not interfere with injection of the granular elastic material into the compartment when a nozzle for injecting the granular elastic material is inserted into a center portion of the bag to fill the bag with the granular elastic material.

7. A method for preparing the sound insulation material of claim 1, the method comprising:

either folding nonwoven fabric or a resin sheet into two sheets or stacking two sheets of nonwoven fabric or a resin, and bonding rims of the two sheets together thereof except for portions of the rims, thereby forming a bag;

filling the bag with a granular elastic material through portions of the rims which are not bonded; and bonding the portions of the rims which are not bonded after filling the bag with the granular elastic material, wherein in the bonding of the rims, a portion to be bonded on the rim and at least a projecting portion to be bonded projecting inward from the rim in one of the sheets are bonded at the same time to a portion to be bonded on the rim and a projecting portion to be bonded projecting inward from the rim in the other sheet.

8. A sound insulation material comprising:

a first sheet of material; and a second sheet of material, wherein inner surfaces of the first and second sheets of material are adhered to each other along at least three sides of the respective sheets via an adhered portion so as to form a bag defining a compartment configured to hold a granular elastic material therein, wherein the adhered portion comprises at least one projecting portion extending inwardly toward a center of the compartment, such that a shape of the compartment is at least partially defined by an inner boundary of the adhered portion including the projecting portion, wherein the adhered portion is attached by heat welding, adhesive, or sewing, or a combination thereof.

9. The sound insulation material of claim 8, wherein the projecting portion has a tapered shape whose width gradually decreases toward a center of the bag.

10. The sound insulation material of claim 8, wherein the granular elastic material enclosed in the bag is at least partially made of foam rubber or a foam resin.

11. The sound insulation material of claim 8, wherein the projecting portion projects inward to a distance at which the adhered portion does not interfere with injection of the granular elastic material into the compartment when a nozzle for injecting the granular elastic material is inserted into a center portion of the bag to fill the bag with the granular elastic material.

* * * * *